US005416287A

United States Patent [19]

Schmidt

[11] Patent Number: 5,416,287

[45] Date of Patent: May 16, 1995

[54] CIRCUIT BREAKER SLOW CLOSE MECHANISM AND METHOD OF USING SAME

[75] Inventor: Lawrence H. Schmidt, Lebanon, Tenn.

[73] Assignee: Square D, Palatine, Ill.

[21] Appl. No.: 104,465

[22] Filed: Aug. 9, 1993

[51] Int. Cl.[6] ..... H01H 13/70

[52] U.S. Cl. ..... 200/400; 200/401; 74/100.1

[58] Field of Search ..... 200/400, 401; 74/100.1, 74/96, 97.1, 575, 577 R, 149, 150; 335/76, 140, 171; 185/40 R

[56] References Cited

U.S. PATENT DOCUMENTS

| | | | |
|---|---|---|---|
| 3,689,720 | 9/1972 | Patel | 200/400 |
| 3,689,721 | 9/1972 | McGuffie | 200/400 |
| 3,944,772 | 3/1976 | Davies | 200/400 |

*Primary Examiner*—Renee S. Luebke
*Assistant Examiner*—David J. Walczak
*Attorney, Agent, or Firm*—Larry I. Golden; Kareem M. Irfan

[57] ABSTRACT

The present invention provides a mechanism for controlling the incremental release and subsequent resetting of a charging mechanism to slowly close an electrical contact operating mechanism of a circuit breaker. The slow close mechanism includes a frame defined by a pair of spaced, generally parallel sideplates connected together and terminating with support legs. The support legs have guide slots to receive a shaft of the charging mechanism. A support block rotatably connects between the sideplates and supports the shaft along the length of the guide slots as the support block rotates. An elongated arm slidingly couples to one of the support legs and has a flange at one end for manual operation. The opposite arm end rotatably couples to a crank arm extending through the one support leg to connect with the support block so that pulling the flange slides the arm and rotates the crank arm and the support block to control the travel of the shaft of the charging mechanism down the guide slots. Operation of a charging mechanism slowly closes the electrical contacts. Preferably, the present invention automatically resets the support block for the shaft of the charging mechanism.

13 Claims, 3 Drawing Sheets

CIRCUIT BREAKER SLOW CLOSE MECHANISM AND METHOD OF USING SAME

FIELD OF THE INVENTION

The present invention relates to low and medium voltage circuit breakers, circuit interrupters, and the like, which require a large force to close the electrical contacts of the breaker and, more particularly, to a mechanism for releasing the charging mechanism to allow slow closing of the contacts.

BACKGROUND OF THE INVENTION

Low and medium voltage, high current circuit breakers generally include a charging mechanism or energy storage device for developing the relatively large force needed to close the breaker. The energy is generally developed by loading a spring through some form of motor means or a manually operated charging handle. The charging mechanism generally includes a pair of heavy extension coil springs that are incrementally loaded (stretched or compressed) by the camming action of a lever that is driven by a ratchet and pawl arrangement. The charging or closing springs are loaded by rotating the ratchet to force a lever arm (and the spring) over center, where they are secured by a latch. The breaker contacts are closed by tripping the latch to discharge the closing springs.

There is a need for a mechanism which incrementally unloads the charging mechanism so that the electrical contact operating mechanism is closed slowly. This allows maintenance and lubrication of the operating mechanism, adjustment of contact pressure settings, monitoring of the contact closing sequence, and testing of the overall mechanical operation of the circuit breaker before it is energized. A slow close mechanism also allows functionally monitoring the timing of the auxiliary switches and control devices.

The prior art provides gagging devices which are attached to the closing springs to allow their partial discharge. One problem with these gagging devices is that there insertion is time-consuming and cumbersome, often requiring an operator to work in tight quarters. Once the maintenance on the circuit breaker is complete, the gagging device must be removed and the charging mechanism reset. Inadvertently leaving a gagging device in the circuit breaker while it is energized could result in severe damage to the breaker and possible injury to the operator. Failure to reset the charging mechanism leaves the circuit breaker operating in an unsafe manner.

There is a need for a slow close mechanism which is made an integral part of the circuit breaker to eliminate time-consuming attachments. Preferably, the slow close mechanism prevents inadvertent operation of the circuit breaker by automatically resetting the charging mechanism.

SUMMARY OF THE INVENTION

Accordingly, the present invention provides a mechanism for controlling the release and subsequent resetting of a charging mechanism to slowly close an electrical contact operating mechanism of a circuit breaker. The slow close mechanism includes a frame defined by a pair of spaced, generally parallel sideplates being connected together and terminating with support legs. Each support leg having a distal end with a guide slot adapted for receiving a shaft of the charging mechanism therethrough.

The inventive slow close mechanism also includes a support block rotatably connecting between the sideplates and being positioned at the distal end of the support legs beneath the guide slots. The support block is adapted to support the shaft of the charging mechanism along the length of the guide slots as the support block rotates.

An elongated arm is further included in the slow close mechanism. One end of the arm slidingly couples to the proximal end of one of the support legs. The arm end has a flange connecting thereto and is adapted for manual operation. The opposite arm end rotatably couples to a crank arm supported by the distal end of the one support leg. The crank arm extends through the one support leg to connect with the support block so that pulling the flange slides the arm and rotates the crank arm and the support block to control the travel of the shaft down the guide slots to unload the charging mechanism and allow the electrical contacts to be slowly closed.

Preferably, the present invention includes means for automatically resetting the support block for the shaft of the charging mechanism. The resetting means includes a spring having one end connecting to the arm and the opposite end to the sideplate. The spring is extended to provide a retracting force to pull the arm and rotate the crank arm and the support block resetting the shaft of the charging mechanism to one end of the guide slots.

The present invention also includes a circuit breaker having a frame defined by a pair of spaced, generally parallel sideplates being connected together and terminating with support legs. The breaker includes operating means, charging means, and closing means. The operating means closes a set of electrical contacts and is supported by the frame. The charging means applies a force to the operating means and is supported by the frame and connected to the operating means. The closing means controls incremental unloading and subsequent resetting of the charging means. The closing means is permanently connected to the frame and the charging means and remains connected during the normal operation of the circuit breaker. The closing means includes a slow close mechanism as described above.

The present invention also contemplates a method of controlling the release and subsequent resetting of a charging mechanism to allow slowly closing an electrical contact operating mechanism of a circuit breaker. The steps of the method include connecting one end of an electrical contact operating mechanism to a charging mechanism for closing the operating mechanism. A force is applied from the charging mechanism to the operating mechanism to hold the electrical contacts in the open position. The force applied by the charging mechanism is unloaded and subsequently the charging mechanism is automatically reset to allow the force to be reapplied to the operating mechanism.

It is an object of the present invention to provide an inventive slow close mechanism which overcomes the aforementioned problems affecting the maintenance of circuit breakers particularly carrying high current loads.

Another object of the present invention is to provide an inventive slow close mechanism which allows an operator to control the closing of an electrical contact operating mechanism for a circuit breaker.

A further object of the present invention is to provide a slow close mechanism which automatically resets the charging mechanism after being released to eliminate inadvertent operation of the circuit breaker following a slow closing procedure.

Still another object of the present invention is provide a slow close mechanism which is inexpensively incorporated into and remains attached to the circuit breaker during normal operation thereof.

Other and further advantages, embodiments, variations and the like will be apparent to those skilled in the art from the present specification taken with the accompanying drawings and appended claims.

BRIEF DESCRIPTION OF THE DRAWINGS

In the drawings, which comprise a portion of this disclosure.

DETAILED DESCRIPTION

Figure 1:
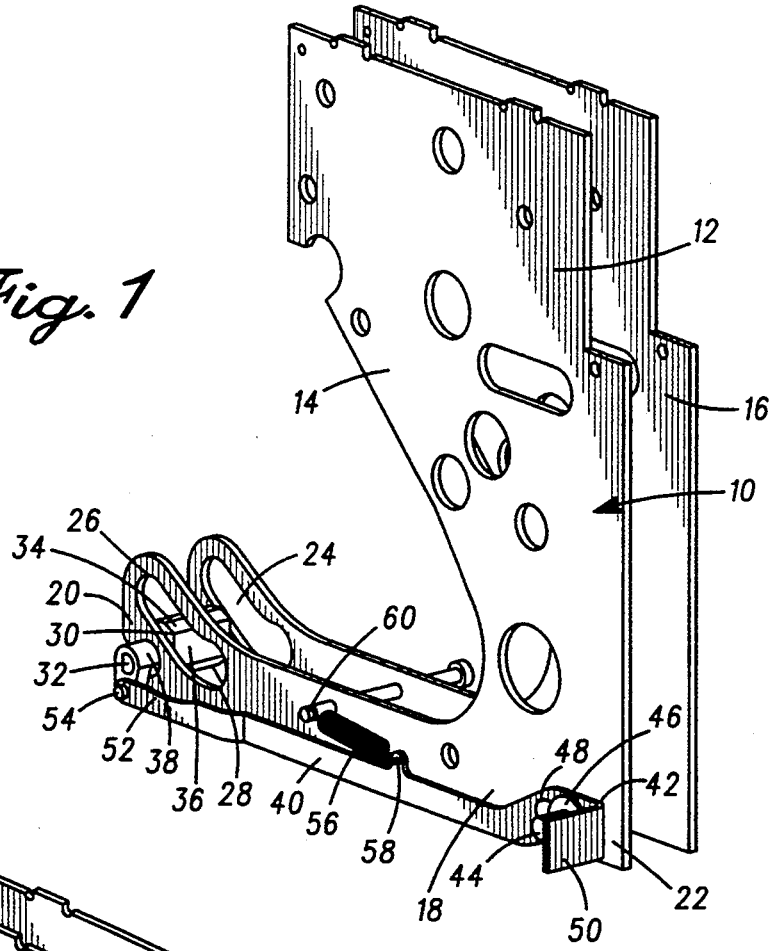
FIG. 1 is a perspective view of an embodiment of the present invention illustrating a slow close mechanism.

Referring to FIG. 1, a circuit breaker slow close mechanism is generally indicated by reference numeral 10. Slow close mechanism 10 includes a frame 12 defined by a pair of spaced, generally parallel sideplates 14, 16. Each sideplate 14 terminates with a support leg 18 having a distal end 20 and proximal end 22. Each support leg 18 has a guide slot 24 positioned at the distal end 20. The guide slots 24 have a top end 26 and a bottom end 28.

A support block 30 is affixed to a support shaft 32 which in turn is rotatably connected between the sideplates 14, 16 at the distal end 20 of the support leg. The support shaft 32 extends perpendicularly through the side plates 14, 16. The support block 30 has a generally ellipsoid shape with decreasing radii as measured from the support shaft 32 to the support block surface. The decreasing radii creates a high end 34 and a low end 36 which are positioned beneath the top end 26 and the bottom end 28, respectively, of the guide slots. A crank arm 38 is affixed to the support block 30 through the sideplate 14 so that the crank arm 38 rotates in unison with the support block 30.

An elongated arm 40 has one end 42 slidingly coupled to the support leg 18 near the proximal end 22. A pin 44 with an integrally formed washer 46 extends perpendicularly outward from the surface of the support leg 18. An arm slot 48 formed at one end 42 of the arm and is sized to allow the pin 44 to extend therethrough. The arm slot 48 is slightly smaller in width than the diameter of the washer 46 to prevent separation of the arm 40 from the support leg 18. A small gap is provided between the arm 40, the washer 46, and the support leg 18 to allow the arm to slide along the support leg 18.

A flange 50 is integrally formed with the end 42 of the arm and extends perpendicularly away from the support leg 18. The flange 50 is adapted to be manually operated by the pulling motion of the operator's hand.

The opposite end 52 of the arm is rotatably connected to the crank arm 38 at pivot pin 54. As the flange 50 pulled outward, the arm slot 48 moves along the pin 44 and the arm 40 pulls on the pivot pin 54 to turn the crank arm 38 and support block 30 in a counter-clockwise motion.

In the preferred embodiment of the present invention, a spring 56 is connected to a hole 58 located approximately in the mid-section of the arm 40. The opposite end of the spring is connected to a securing pin 60 extending perpendicularly from the surface of the support leg 18 near the distal end 20. When the flange 50 and, consequently, the arm 40 is pulled and the support block 30 rotated, the spring 56 is stretched. As the flange 50 is released, the spring 56 causes the arm 40 to push the pivot pin 54 and turn the crank arm 38, resetting the support block 30 in a clockwise motion. The force exerted by stretching the spring 56 is pre-determined to be sufficient to automatically reset the arm 40 when the force pulling on the flange 50 is released. As a consequence, the support block 30 is likewise automatically reset to the upright starting position illustrated in FIG. 1.

Other means for automatically resetting the arm 40 and the support block 30 are contemplated by the present invention. For example, but not limited to, the spring 56 may be located in a different position on the arm 40 and relative to the support leg 18. Further, other energy storage devices like a torsion rod can be substituted for the spring 56.

Figure 2:
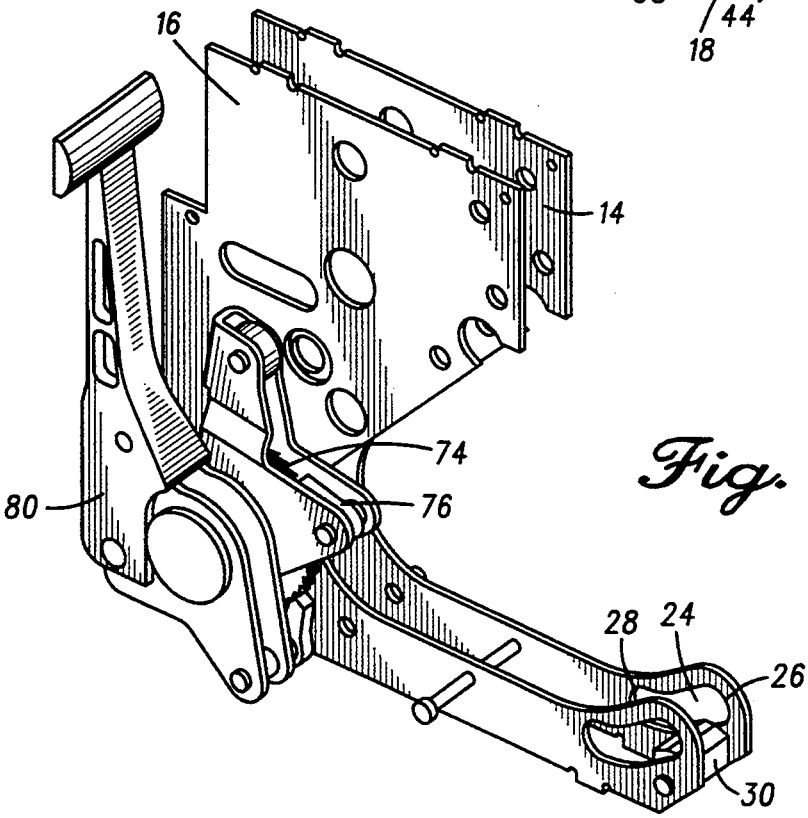
FIG. 2 is a perspective view of the opposite side of the frame in FIG. 1 illustrating a ratchet and pawl arrangement relative to the inventive slow close mechanism.
Figure 3:
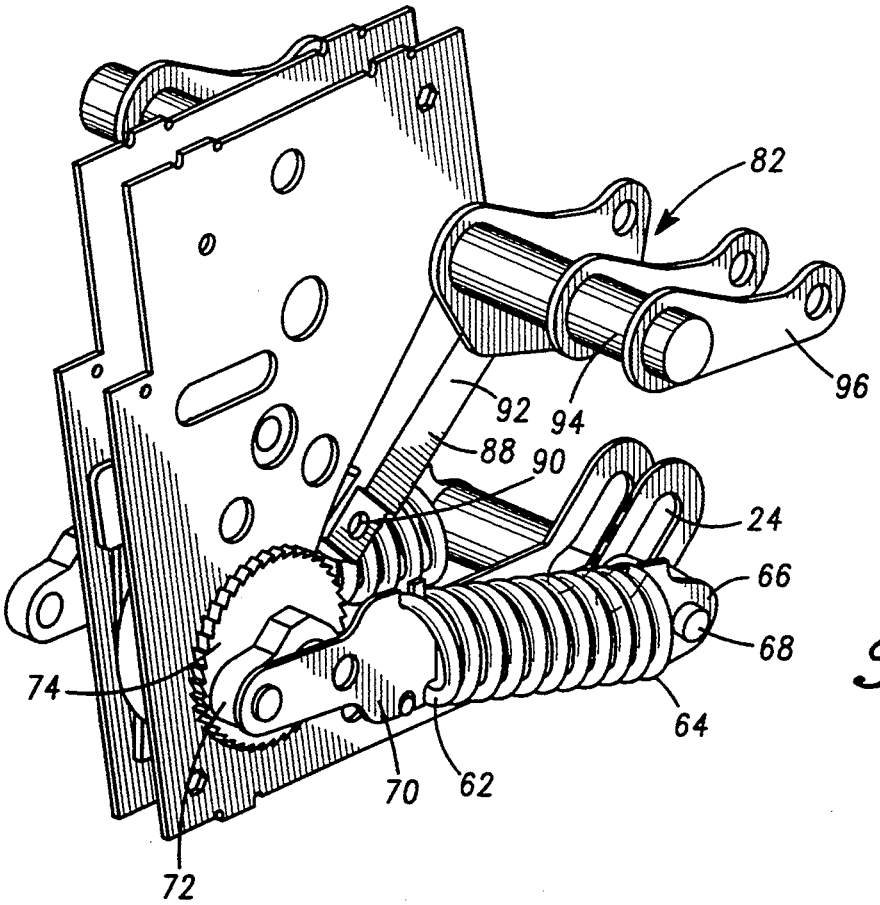
FIG. 3 is a perspective view of the inventive slow close mechanism unloading the charging mechanism and closing the electrical contact operating mechanism.
Figure 4:
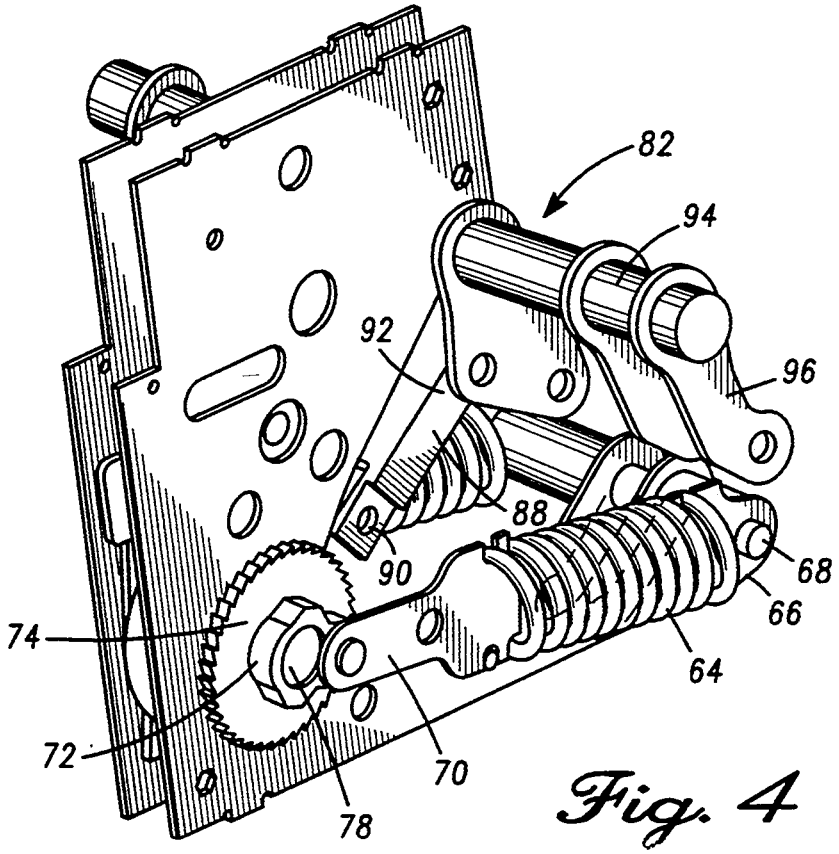
FIG. 4 is a perspective view of the inventive slow close mechanism resetting the charging mechanism and opening the operating mechanism.

Referring now to FIGS. 2 through 4, a charging mechanism generally designated as 62 is illustrated. The charging mechanism 62 includes charging springs 64 connected at one end 66 to a shaft 68. The guide slots 24 are sized to accommodate the shaft 68 extending perpendicularly therethrough and allow the shaft 68 to slidingly travel along the length of the guide slots 24. The support block 30 abuts the bottom of the shaft 68 to control its travel along the length of the guide slots 24.

The other end 70 of the charging springs rotatably connects to a ratchet crank arm 72. The ratchet crank arm 72 is connected to a ratchet wheel 74 and a charging pawl 76 by means of a crankshaft 78. Manually operating a charging handle 80 turns the crankshaft 78 and ratchet wheel 74 as the charging pawl 76 moves along the teeth of the ratchet wheel 74. In turn, the ratchet crank arm 72 extends or loads the charging springs 64. Repetitive pumping or cranking of the charging handle 80 results in incremental rotation of the ratchet wheel 74 and the loading of the charging springs 64. When the crank arm 72 reaches an over center position the charging springs 64 snap into a fully charged position. Loading of the charging mechanism 62 can also be accomplished by a motor means (not shown) as is well-known in the art.

Figure 5:
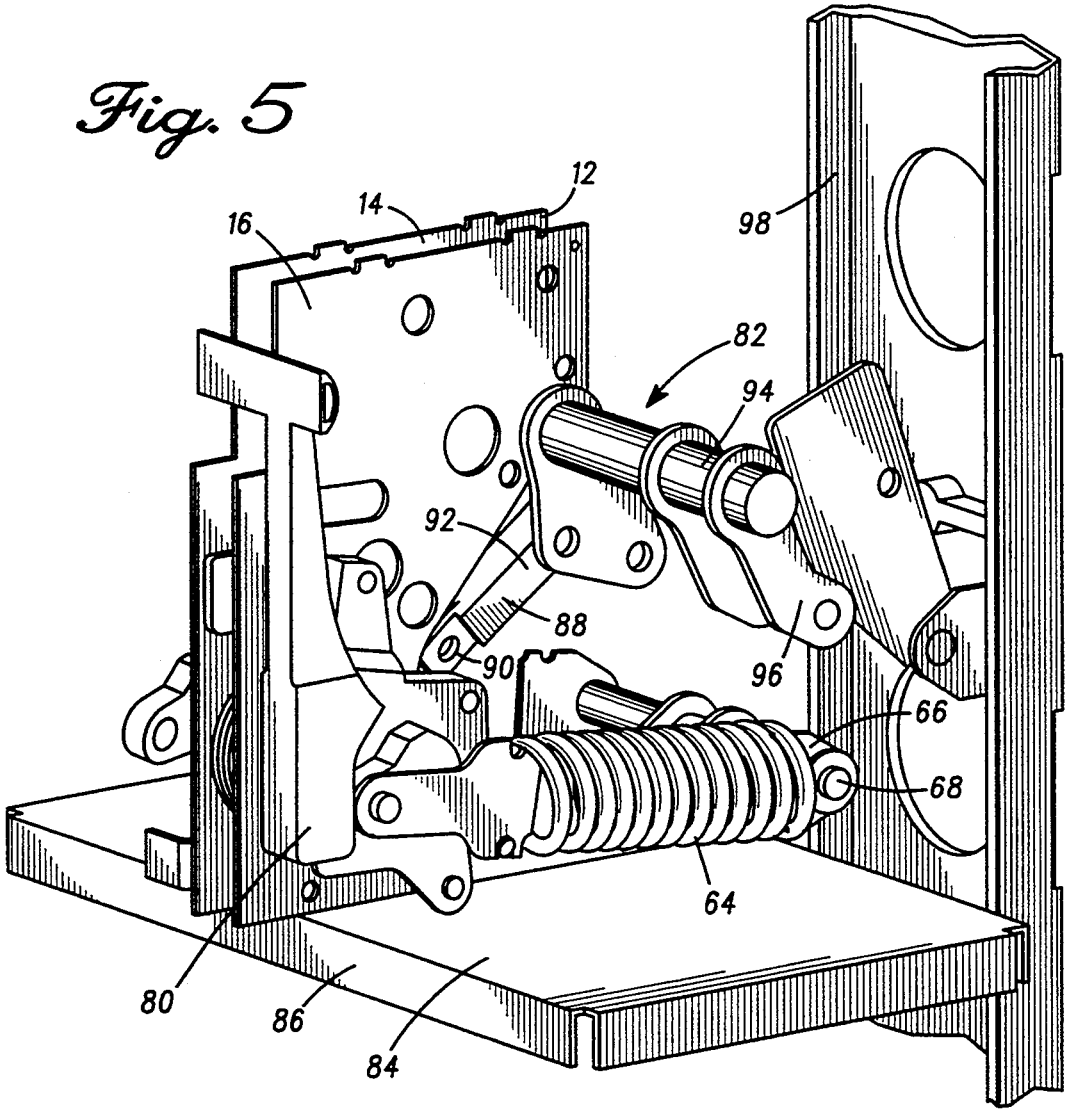
FIG. 5 is a perspective view of a circuit breaker isolating the operating mechanism, charging mechanism and inventive slow close mechanism.

Referring now to FIG. 5, an electrical contact operating mechanism 82 in a circuit breaker 84 is illustrated. A shelf 86 of the circuit breaker supports the frame 12. The operating mechanism 82 includes a drive link 88 connected at one end 90 to the charging mechanism 62. The other end 92 of the drive link 88 rotatably connects to a contact pole shaft 94 supported by the sideplates 14, 16. A pole lever 96 is affixed to the contact pole shaft 94 which rotatably connects to an assembly 98 of movable electrical contacts. The assembly 98 is aligned with a corresponding set of stationary electrical contacts (not shown) to move between an open and closed position therewith.

When the closing springs 64 are loaded, a closing latch holds the extended closing springs in the extended position. The closing latch is standard in the prior art and is not illustrated here. When the closing latch is tripped, the release of the closing springs 64 causes the drive link 88 to exert a force in the direction towards the assembly 98. Operation of the charging handle 80 indexes the movable electrical contacts into a closed position with the stationary electrical contacts.

In the operation of the present invention, the circuit breaker 84 is typically taken out of service for maintenance. As shown specifically in FIG. 5, the charging springs 64 are loaded or fully extended between the shaft 68 by the support block 30 (FIG. 1) at the top end 26 of the guide slots and the ratchet crank arm 72. The pole ever 96 is in the position controlling the assembly 98 to have the electrical contacts in the open position.

To slowly close the electrical contact assembly 98, the flange 50 specifically illustrated in FIG. 1 is manually pulled by the operator. In turn, the arm 40 pulls on the crank arm 38 to rotate it and the support block 30 in a counter-clockwise direction. To hold the shaft 68 at the top end 26 of the guide slots, the high end 34 of the support block 30 abuts the bottom of the shaft 68. As the support block 30 rotates, the radii of the support block 30 decreases and the shaft 68 incrementally slides along the support block surface towards the lower end 36. This results in the shaft 68 traveling down the guide slots 24 towards the bottom end 28. As the shaft 68 travels the length of the guide slots 24, a pulling force is applied by the loaded charging springs 64 which keeps the shaft 68 abutting the top of the support block 30.

When the support block 30 is fully rotated to its low end 36 by the operator pulling on the flange 50, the shaft 68 travels to the bottom end 28 of the guide slots as illustrated in FIG. 3. At this point, the charging mechanism 62 is unloaded. The ratchet wheel 74 is released and is free to rotate. The ratchet wheel 74 is rotated by operation of the charging handle 80, causing the drive link 88 to incrementally rotate the pole lever 96 counterclockwise to slowly close the electrical contact assembly 98 as shown by its position in FIG. 3.

To automatically reset the slow close mechanism 10, the operator releases the flange 50. In doing so, the spring 56 pulls the arm 40 which rotates the crank arm 38 and support block 30 in a clockwise direction. The shaft 68 automatically travels back up the guide slots 24 when the charging handle 80 is operated to perform the slow closing of the contact assembly 98. This provides for the shaft 68 to reset on top of the support block 30 at the top end of the guide slots 24.

Operation of the charging handle 80 indexes the ratchet wheel 74 approximately 180 degrees. The ratchet crank arms 72 rotate with the ratchet wheel 74 which returns the shaft 68 to the top end 26 of the guide slots. The operating mechanism 82 moves the drive link 88 to rotate the pole lever 96 counter-clockwise to close the contact assembly 98.

One of the advantages of the present invention is that the operator can assert a wide range of control over the closing of the electrical contacts. The unloading of the charging mechanism 62 consequently allows incremental closing of the electrical contact assembly 98. Furthermore, the operator can pause at any time during the closing of the contact assembly 98.

Another of the unique features of the preferred embodiment is that the slow close mechanism 10 automatically resets the charging mechanism. The inadvertent energizing of the circuit breaker 84 with the contact assembly 98 in the closed position is avoided.

The present invention is specifically disclosed for use with one, two, and three pole circuit breakers sold by the Square D Company under the catalog designation low-voltage power circuit breakers. These circuit breakers are capable of handling continuous currents in the range of about 600 to about 4,000 amps.

The present invention also contemplates a method of controlling the release of a charging mechanism to allow slowly closing an electrical contact operating mechanism of a circuit breaker. The steps of the method include connecting one end of an electrical contact operating mechanism to a charging mechanism for closing the operating mechanism. A force is applied from the charging mechanism to the operating mechanism to hold the electrical contacts in the open position. The force applied by the charging mechanism is unloaded and the charging mechanism is automatically reset to allow the force to be reapplied to the operating mechanism.

The unloading step includes moving the opposite end of the charging mechanism in closer proximity to the operating mechanism. The charging mechanism and operating mechanism is of the description provided above. Rotating the support block allows the shaft of the charging mechanism to travel through the guide slots provided in the support legs of the circuit breaker frame.

The step of rotating the support block includes slidingly coupling one end of an elongated arm to the proximal end of one of the support legs. The opposite end of the arm is rotatably coupled to a crank arm connected to the support block so that manually pulling the arm rotates the crank arm and the support block as described above.

Resetting the charging mechanism is accomplished by automatically resetting the support block and the shaft to one end of the guide slots as described above. One end of a spring is connected to the arm and the other end to the sideplate. The spring is charged to provide a retracting force pulling the arm and rotating the crank arm and the support block to move the shaft to one end of the guide slots.

As those skilled in the art will appreciate, the inventive slow close mechanism can be adapted and configured for use with a wide variety of circuit breakers and other circuit interrupters. The inventive slow close mechanism is most readily applied in low and medium voltage, high current circuit breakers since they utilize a charging mechanism to quickly exert great force when closing the electrical contacts. The present invention, however, is also suitable for use in high voltage applications. Although a circuit breaker has been used herein to describe an application of the present invention, the term is defined to include circuit interrupters including, but not limited to, single or polyphase circuit breakers, vacuum or air circuit breakers, fusible switches, fuse trucks, switchgear and the like.

While particular embodiments and applications of the present invention have been illustrated and described, it is to be understood that the invention is not limited to the precise construction and compositions disclosed herein and that various modifications, changes, and variations which will be apparent to those skilled in the art may be made in the arrangement, operation, and details of construction of the invention disclosed herein without departing from the spirit and scope of the invention as defined in the appended claims.

What is claimed is:

1. A mechanism for controlling the release and subsequent resetting of a charging mechanism which is connected to and operates to slowly close an electrical contact operating mechanism of a circuit breaker, the slow close mechanism comprising:

a frame defined by a pair of spaced, generally parallel sideplates being connected together and terminating with support legs, each support leg having a distal end with a guide slot adapted for receiving a shaft of the charging mechanism therethrough:

a support block rotatably connecting between the sideplates and being positioned at the distal end of the support legs beneath the guide slots, the support block adapted to support the shaft of the charging mechanism along the length of the guide slots as the support block rotates; and an elongated arm, one end of the arm slidingly coupling to the proximal end of one of the support legs, the arm end having a flange connecting thereto and being adapted for manual operation, the opposite arm end rotatably coupling to a crank arm supported by the distal end of the one support leg, the crank arm extending through the one support leg to connect with the support block so that pulling the flange slides the arm and rotates the crank arm and the support block to control the travel of the shaft down the guide slots to unload the charging mechanism which allows the electrical contacts to be slowly closed, while pushing the shaft up the guide slots resets the charging mechanism.

2. The slow close mechanism defined in claim 1 wherein the slow close mechanism further includes means for automatically resetting the support block for the shaft of the charging mechanism.

3. The slow close mechanism defined in claim 2 wherein the resetting means includes a spring having one end connecting to the arm and the opposite end to the sideplate, the spring being extended to provide a retracting force to pull the arm and rotate the crank arm and the support block.

4. The slow close mechanism defined in claim 1 wherein one end of the arm includes a slot and the proximal end of the one support leg includes a retaining pin upstanding therefrom, the retaining pin extending through the slot and slidingly coupling the arm end to the one support leg.

5. The slow close mechanism defined in claim 1 wherein the support block further includes a support shaft extending therethrough and rotatably connecting each end of the support shaft to the sideplates, the shape of the support block having a shape with decreasing radii measured from the pole shaft to the surface of the support block so that greatest radii corresponds to the high end of the support block which extends to one end of the guide slots.

6. A circuit breaker comprising:

a frame defined by a pair of spaced, generally parallel sideplates being connected together and terminating with support legs;

operating means for closing a set of electrical contacts, the operating means being supported by the frame;

charging means for applying a force to the operating means, the charging means having a crankshaft supported for rotation on the sideplates, a pair of closing springs with one end of each closing spring connecting to the crankshaft, the crankshaft connecting to the operating means, the opposite end of each closing spring connecting to a shaft extending perpendicularly across each opposite spring end; and closing means for unloading and subsequent resetting of the charging means, the closing means being permanently connected to the frame and the charging means and remaining connected during the normal operation of the circuit breaker, the closing means includes each support leg of the frame having a distal end with a guide slot receiving the shaft therethrough, a support block rotatably connecting between the sideplates and being positioned at the distal end of the support legs beneath the guide slots, the support block supporting the shaft along the length of the guide slots as the support block rotates, and an elongated arm having one end slidingly coupling to the proximal end of one of the support legs, the arm end having a flange connecting thereto and being adapted for manual operation, the opposite arm end rotatably coupling to a crank arm supported by the distal end of the one support leg, the crank arm extending through the one support leg to connect with the support block so that pulling the flange slides the arm and rotates the crank arm and the support block controlling the shaft of the charging mechanism to travel down the guide slots to unload the charging means and allow the electrical contacts to be slowly closed, while pushing the shaft up the guide slots resets the charging means.

7. The circuit breaker defined in claim 6 wherein one end of the arm includes a slot and the proximal end of the one support leg includes a retaining pin upstanding therefrom, the retaining pin extending through the slot and slidingly coupling the arm end to the one support leg.

8. The circuit breaker defined in claim 6 wherein the support block further includes a support shaft extending therethrough and rotatably connecting each end of the support shaft to the sideplates, the shape of the support block having a shape with decreasing radii measured from the support shaft to the surface of the support block so that greatest radii corresponds to the high end of the support block which extends to one end of the guide slots.

9. The circuit breaker defined in claim 6 wherein the closing means further includes resetting means for automatically resetting the charging means.

10. The circuit breaker defined in claim 9 wherein the resetting means includes a spring having one end connected to the arm and the other end to the sideplate, the spring being extended to provide a retracting force to pull the arm to rotate the crank arm and the support block.

11. A method of controlling the release of a charging mechanism to allow slowly closing an electrical contact operating mechanism of a circuit breaker, the steps of the method comprising:

connecting one end of an electrical contact operating mechanism to a charging mechanism for closing the operating mechanism;

applying a force from the charging mechanism to the operating mechanism to hold the electrical contacts in the open position;

supporting the circuit breaker on a frame defined by a pair of spaced, generally parallel sideplates being connected together and terminating with support legs, each support leg having a distal end with a guide slot;

providing a pair of closing springs with one end connected to the operating mechanism and the opposite end connected to a perpendicularly extending shaft;

inserting the shaft through the guide slob positioned in each supporting leg;

supporting the shaft with a support block;

rotating the support block to allow the shaft to travel through the guide slots; and automatically resetting the charging mechanism to allow the force to be reapplied to the operating mechanism.

12. The method of claim 11 wherein the rotating step includes:

slidingly coupling one end of an elongated arm to the proximal end of one of the support legs; and rotatably coupling the opposite end of the arm to a crank arm connected to the support block so that manually pulling the arm rotates the crank arm and the support block.

13. The method of claim 11 wherein the resetting step further includes:

connecting one end of a spring to the arm and the other end to the sideplate; and charging the spring to provide a retracting force pulling the arm and rotating the crank arm and the support block.

* * * * *